United States Patent [19]

Branchi

[11] Patent Number: 4,891,929

[45] Date of Patent: Jan. 9, 1990

[54] METHOD FOR THE PRODUCTION OF PRISMATIC CONTAINERS WITH PLANE GABLE SURFACES WITHOUT ANY LATERAL EARS

[75] Inventor: Franca Branchi, Parma, Italy

[73] Assignee: Italpack S.p.A., Mercogliano, Italy

[21] Appl. No.: 282,904

[22] Filed: Dec. 12, 1988

Related U.S. Application Data

[63] Continuation of Ser. No. 44,025, filed as PCT EP86/00475 on Aug. 12, 1986, published as W087/01093 on Feb. 26, 1987, abandoned.

[30] Foreign Application Priority Data

Aug. 13, 1985 [IT] Italy ..... 4840 A/85

[51] Int. Cl.[4] ..... B65B 9/12; B65D 75/48

[52] U.S. Cl. ..... 53/451; 53/476

[58] Field of Search ..... 53/451, 459, 476, 551, 53/552

[56] References Cited

U.S. PATENT DOCUMENTS

| | | | |
|---|---|---|---|
| 3,006,121 | 10/1961 | Omori | 53/551 |
| 3,263,391 | 8/1966 | Wallsten | 53/451 |
| 3,426,499 | 2/1969 | Paige | 53/451 |
| 3,456,861 | 7/1969 | Weltlen | 53/451 X |
| 3,543,467 | 12/1970 | Leasure | 53/451 |
| 4,081,943 | 4/1978 | Leasure et al. | 53/451 X |
| 4,637,199 | 1/1987 | Steck et al. | 53/551 X |
| 4,747,253 | 5/1988 | Schulte | 53/451 X |

*Primary Examiner*—James F. Coan

*Attorney, Agent, or Firm*—Fleit, Jacobson, Cohn, Price, Holman & Stern

[57] ABSTRACT

In a method of forming prismatic liquid containers from continuously fed tubing, lateral regions of the tube to be connected by sealing strips are pressed inwardly before adjacent gable surfaces of the tubing are pressed together and sealed, thereby avoiding the formation of unsightly projections and any internal air cushion.

2 Claims, 1 Drawing Sheet

METHOD FOR THE PRODUCTION OF PRISMATIC CONTAINERS WITH PLANE GABLE SURFACES WITHOUT ANY LATERAL EARS

This application is a continuation of application Ser. No. 044,025, filed as PCT EP86/00475 on Aug. 12, 1986, published as WO87/01093 on Feb. 26, 1987, now abandoned.

FIELD OF THE INVENTION

The invention is concerned with a method for the production of prismatic containers without any lateral ears, with locking surfaces in the form of adjoining gable surfaces and with transverse sealing bands, consisting of a flexible tube that is filled with a liquid substance and is supplied continuously.

BACKGROUND OF THE INVENTION

Machines for packing liquid substances in flexible containers are already known. These containers have the characteristic shape of a parallelepiped with ugly and inconvenient lateral ears that are bent onto the outside of the body of the container and are fastened there. In plants for the production of containers of that type, a flat band of flexible material is suppied from a reel and wrapped around a tube that is closed longitudinally and continuously filled with the liquid substance to be packed.

Those installations that operate continuously with a certain hydrostatic pressure are antiseptic as such and, for that reason, are particularly suitable for packing sterile substances without any contact with the atmospheric air. No cushion of outside air is inclosed within the containers filled in those installations and inclosed therein. Additional types of packing machinery are known in which cardboard boxes are filled with the fluid to be packed. The opening of the boxes is sealed subsequently in the characteristic form of a hood with two gable surfaces. These packaging machines, which do not operate at a certain height of hydrostatic pressure, include, of necessity, a cushion of outside air in the container. Beyond that, it is necessary to use a pressurized tunnel; consequently, a cushion of sterile air is inclosed in the container, of necessity.

Up to this time, no packing method has been known in which the two problems of elimination of the undesirable outer lateral ears and the elimination of the air cushion inside the container, are solved at the same time.

For that reason, the invention is based on the idea of eliminating the disadvantages known from the state of the art and of creating a method for the production of prismatic containers without any lateral ears and with sealing surfaces in the form of adjoining gable surfaces, while no air cushion is locked in the container.

SUMMARY OF THE INVENTION

In accordance with the invention, lateral container zones which are joined by a transverse sealing band, are urged toward the inside of the tube, before any transverse tube flattening devices start operating. In a convenient embodiment of the method in accordance with the invention, the lateral zones urged toward the inside of the tube are guided below the resulting gable surfaces and below the transverse sealing band.

An example of the embodiment of the invention is discussed in the following, on the basis of the drawing.

DESCRIPTION OF PREFERRED EMBODIMENT

Figure 1:
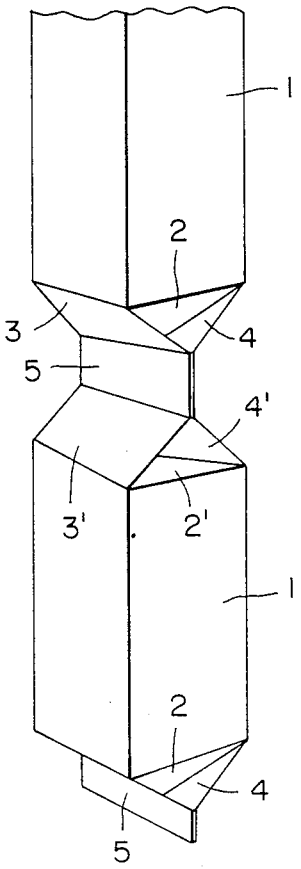
FIG. 1 is a schematic perspective view of a flexible tube which is filled completely with a liquid substance, transversely flattened, sealed, cut across, and supplied continuously.

It is evident from FIG. 1 that opposing lateral zones 2, 4, 2', 4' have been urged toward one another by means of members not shown, so as to prevent the projection of triangular ears from the completed prismatic container which would result from the flattening of the transverse sealing band 5.

Accordingly, the ends of the container have triangular zones, 2, 4, 2', 4' that are located adjacent the gable surfaces 3, 3'. Each end of the container has two gable surfaces. Those gable surfaces 3, 3' may be placed next to one another, so that they run perpendicularly to the lateral surfaces of the container. As noted above in the description of FIG. 1, to form a prismatic container in accordance with the invention, flexible tube 1 is filled completely with a liquid substance. Opposing lateral regions 2, 4 (or 2', 4') are pressed toward one another, and then the gable surfaces of the tube are transversely flattened, sealed to form transverse sealing band 5, and cut.

Figure 2:
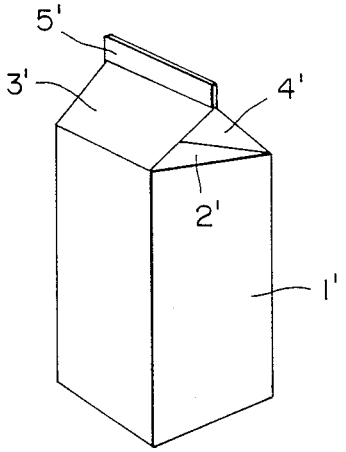
FIG. 2 is a perspective view of the container with flattened bottom and with a top that has been designed with two gable surfaces.

In FIG. 2, the container 1' with the flattened or laid-on bottom and the top is shown in the characteristic form of a hood with two gable surfaces.

This container 1' which has been sealed at a certain hydrostatic pressure, does not have any air cushion inside.

The method of the invention may be applied by packing machinery of any design, for example by packing machines having a vertical design, and in which one or several sealing parts are developed as intermittent crank gear assemblies or conveyer belts in continuous motion.

The method may also be carried out by means of packing machines with horizontal design of sealing parts mounted over a horizontal wheel in continuous rotation.*

In addition, the method in accordance with the invention may be applied to packing machines with one or more stations that are supplied individually and actuated intermittently.

It is essential that the packing machines used operate at a certain hydraulic pressure, while the structural and functional arrangement does not matter, as long as they are capable of producing containers with two gable surfaces at their ends and without any air cushion inside.

I claim:

1. A method for the production of prismatic containers having closure surfaces in the form of adjoining gable surfaces terminating in transverse sealing strips comprising the steps of:

filling completely a tube of continuous material with a liquid to provide a certain hydrostatic pressure within said tube;

continuously feeding the filled tube of continuous material;

pressing opposing lateral regions of the filled tube, which are to be connected by a transverse sealing strip, inwardly toward one another;

subsequently actuating transverse flattening members which press the gable surfaces together; and sealing the gable surfaces together to form said transverse sealing strip and complete production of one of said prismatic containers, while simultaneously maintaining said certain hydrostatic pressure in said tube, so as to prevent an air cushion from forming inside said filled tube as said transverse flattening members are actuated, said one prismatic container being free of any lateral projections therefrom in the region of said sealing strip.

2. A method for the production of prismatic containers having closure surfaces in the form of adjoining gable surfaces terminating in transverse sealing strips comprising the steps of:

filling completely a tube of cardboard material with a liquid to provide a certain hydrostatic pressure within said tube;

continuously feeding the filled tube of cardboard material;

pressing opposing lateral regions of the filled tube, which are to be connected by a transverse sealing strip, inwardly toward one another;

subsequently actuating transverse flattening members which press the gable surfaces together; and sealing the gable surfaces together to form said transverse sealing strip and complete production of one of said prismatic containers, while simultaneously maintaining said certain hydrostatic pressure in said tube, so as to prevent an air cushion from forming inside said filled tube as said transverse flattening members are actuated, said one prismatic container being free of any lateral projections therefrom in the region of said sealing strip.

* * * * *